US009096980B2

(12) United States Patent
Ricketts

(10) Patent No.: US 9,096,980 B2
(45) Date of Patent: Aug. 4, 2015

(54) SNOWBLOWER CHUTE CONTROL DEVICES, SYSTEMS, AND METHODS

(71) Applicant: Honda Motor Co., Ltd., Tokyo (JP)

(72) Inventor: Tyler Ricketts, Haw River, NC (US)

(73) Assignee: Honda Motor Co., Ltd., Tokyo (JP)

( * ) Notice: Subject to any disclaimer, the term of this patent is extended or adjusted under 35 U.S.C. 154(b) by 267 days.

(21) Appl. No.: 13/644,246

(22) Filed: Oct. 3, 2012

(65) Prior Publication Data

US 2014/0090278 A1 Apr. 3, 2014

(51) Int. Cl.

| | |
|---|---|
| ***E01H 5/04*** | (2006.01) |
| ***G05G 5/06*** | (2006.01) |
| *G05G 1/04* | (2006.01) |

(52) U.S. Cl.

CPC ..... *E01H 5/045* (2013.01); *G05G 5/06* (2013.01); *G05G 1/04* (2013.01); *Y10T 74/20474* (2015.01)

(58) Field of Classification Search

CPC ..... E01H 5/045; B62D 51/04; B62D 51/001; G05G 5/06; G05G 1/04; Y10T 74/20474

USPC ..... 37/253, 256, 259, 266

See application file for complete search history.

(56) References Cited

U.S. PATENT DOCUMENTS

| | | | | |
|---|---|---|---|---|
| 948,804 | A | 2/1910 | Winterling | |
| 3,135,234 | A | 6/1964 | Turnidge | |
| 4,130,952 | A * | 12/1978 | Dion | 37/241 |
| 4,150,501 | A | 4/1979 | Hayashi | |
| 4,191,064 | A | 3/1980 | Houk et al. | |
| 4,205,468 | A | 6/1980 | Greider | |
| 4,457,086 | A * | 7/1984 | Bacon | 37/257 |
| 4,476,643 | A * | 10/1984 | Hilchey et al. | 37/245 |
| 4,756,101 | A * | 7/1988 | Friberg et al. | 37/244 |
| 4,862,607 | A * | 9/1989 | Wacker | 37/260 |
| D457,171 | S * | 5/2002 | Fowler | D15/11 |
| 6,381,881 | B1 * | 5/2002 | Heismann | 37/260 |
| 6,662,477 | B2 * | 12/2003 | Dowe et al. | 37/257 |
| 6,745,548 | B1 * | 6/2004 | Phillip et al. | 56/10.5 |
| D494,193 | S * | 8/2004 | Martin et al. | D15/12 |
| 7,194,827 | B2 | 3/2007 | Mercer et al. | |
| 7,401,425 | B2 * | 7/2008 | Friberg et al. | 37/241 |
| 7,624,521 | B2 * | 12/2009 | White et al. | 37/260 |
| 2002/0174572 | A1 * | 11/2002 | Prochnow et al. | 37/257 |
| 2002/0189137 | A1 * | 12/2002 | Cox et al. | 37/242 |
| 2004/0255493 | A1 * | 12/2004 | Friberg et al. | 37/260 |
| 2006/0096134 | A1 * | 5/2006 | Mercer et al. | 37/244 |
| 2008/0209771 | A1 | 9/2008 | Jerger et al. | |
| 2008/0263906 | A1 * | 10/2008 | Wang | 37/257 |

(Continued)

*Primary Examiner* — Jamie L McGowan

(74) *Attorney, Agent, or Firm* — Jenkins, Wilson, Taylor & Hunt, P.A.

(57) ABSTRACT

Snowblower chute control devices, systems, and methods are provided and can include a positioning rod having a first end pivotably connected to a machine handle and a second end connected to a snowblower chute such that rotation of the positioning rod about a longitudinal axis causes rotation of the snowblower chute. A control lever can be connected to the positioning rod such that the control lever is substantially fixed with respect to the positioning rod for rotation about the longitudinal axis but is pivotable with respect to the positioning rod about a pivot axis that intersects the longitudinal axis. The snowblower chute position control device can further include a positioning guide configured to retain the control lever at one or more selected angular positions with respect to the longitudinal axis corresponding to one or more desired rotational positions of the snowblower chute.

22 Claims, 5 Drawing Sheets

(56) References Cited

U.S. PATENT DOCUMENTS

2011/0094129 A1* 4/2011 Rowe et al. ..... 37/246
2011/0314707 A1* 12/2011 Raftery ..... 37/224
2012/0180346 A1* 7/2012 Gerrits et al. ..... 37/251

* cited by examiner

SNOWBLOWER CHUTE CONTROL DEVICES, SYSTEMS, AND METHODS

BACKGROUND

Snowblowers are known having upright chutes through which a snow stream can be thrown. It is common for the chute to be designed such that it can be rotated from one side to the other to direct where the snow stream is deposited laterally relative to the snowthrower. Typically, this rotation is accomplished by directly turning the chute (e.g., using a connected handle), manually turning a handcrank that turns the chute through a system of gears, or using a complicated mechanical system.

Each of these types of mechanisms has its own drawbacks though. For example, direct rotation of the chute can require that the operator move from behind the machine handle, which can be inconvenient and annoying to many users. Hand-cranked systems can be tiring and inconvenient to use, particularly where one must redirect the snow stream frequently as when going back and forth on a driveway or the like. More advanced mechanical systems can add costs to the design and manufacture of the snowblower, and they can contain one or more electric motors and a large number of components that can break or otherwise fail.

As a result, it would be desirable for a snowblower chute control device, system, and method to be durable, reliable, and simple to use while still providing effective operation of the snowblower chute.

SUMMARY

In accordance with this disclosure, snowblower chute control devices, systems, and methods are provided. In one aspect, a snowblower chute position control device is provided. The snowblower chute position control device can include a positioning rod having a first end pivotably connected to a machine handle and a second end connected to a snowblower chute such that rotation of the positioning rod about a longitudinal axis causes rotation of the snowblower chute. A control lever can be connected to the positioning rod such that the control lever is substantially fixed with respect to the positioning rod for rotation about the longitudinal axis but is pivotable with respect to the positioning rod about a pivot axis that intersects the longitudinal axis. The snowblower chute position control device can further include a positioning guide having a retention surface facing the control lever. The positioning guide can be configured to retain the control lever at one or more selected angular positions with respect to the longitudinal axis corresponding to one or more desired rotational positions of the snowblower chute. A biasing element can be configured for exerting a force to urge the control lever towards the retention surface of the positioning guide.

In another aspect, a rotatable snowblower chute and control system can include a snowblower chute rotatable with respect to a snowblower housing, a machine handle extending from the snowblower housing, and a positioning rod having a first end pivotably connected to the machine handle and a second end connected to the snowblower chute such that rotation of the positioning rod about a longitudinal axis causes rotation of the snowblower chute. A control lever can be connected to the positioning rod such that the control lever is substantially fixed with respect to the positioning rod for rotation about the longitudinal axis but is pivotable with respect to the positioning rod about a pivot axis that intersects the longitudinal axis. A positioning guide can include a retention surface facing the control lever, the retention surface including one or more retention grooves configured for receiving the control lever at one or more predetermined angles corresponding to one or more predetermined rotational positions of the snowblower chute. A biasing element can be configured for exerting a force to urge the control lever towards the retention surface of the positioning guide.

In yet another aspect, a method for rotating a snowblower chute is provided. The method can include pivotably connecting a positioning rod to a snowblower chute such that rotation of the positioning rod about a longitudinal axis causes rotation of the snowblower chute. The method can further include rotating a control lever connected to the positioning rod about the longitudinal axis to cause rotation of the positioning rod. Rotating the control lever can include pivoting the control lever with respect to the positioning rod about a pivot axis that intersects the longitudinal axis to disengage the control lever from a positioning guide, wherein the positioning guide can include a retention surface facing the control lever, and it can be configured to retain the control lever at one or more selected angular positions with respect to the longitudinal axis corresponding to one or more desired rotational positions of the snowblower chute.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
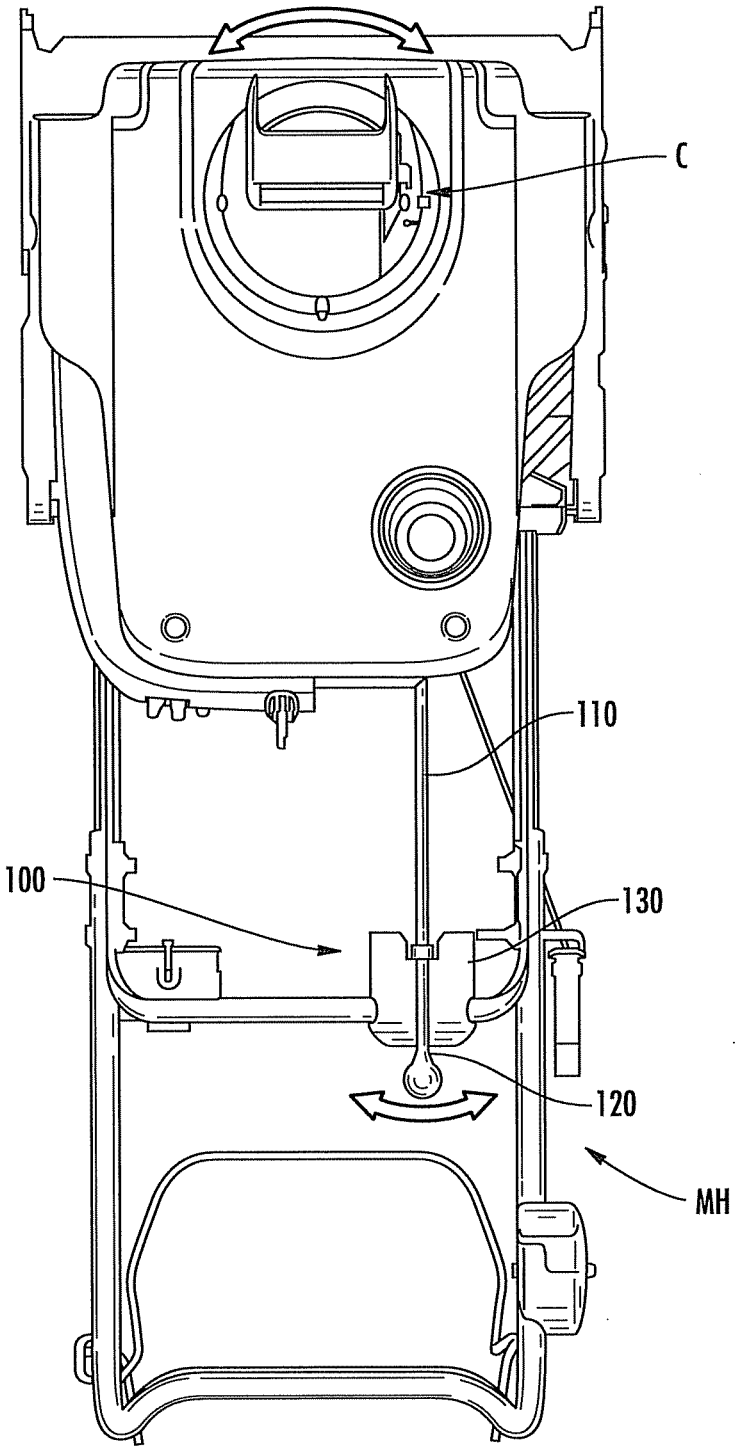
FIG. 1 is a top view of a snowblower having a chute control system according to an embodiment of the presently disclosed subject matter.

The present subject matter provides devices, systems, and methods for controlling the angular position of a snowblower chute. In one aspect, the present subject matter provides a chute control system, generally designated 100, that can be coupled to a snowblower chute C of a snowblower as shown in FIG. 1. Chute control system 100 can comprise a positioning rod 110 having a first end 112 pivotably connected to a machine handle MH and a second end 114 connected to snowblower chute C such that rotation of positioning rod 110 about a longitudinal axis LA can cause rotation of snowblower chute C. The coupling of the rotation of positioning rod 110 to the rotation of snowblower chute C can be accomplished by any of a variety of mechanisms known to those having ordinary skill in the art, including but not limited to bevel gear systems, worm drives, or the like.

Figure 2A:
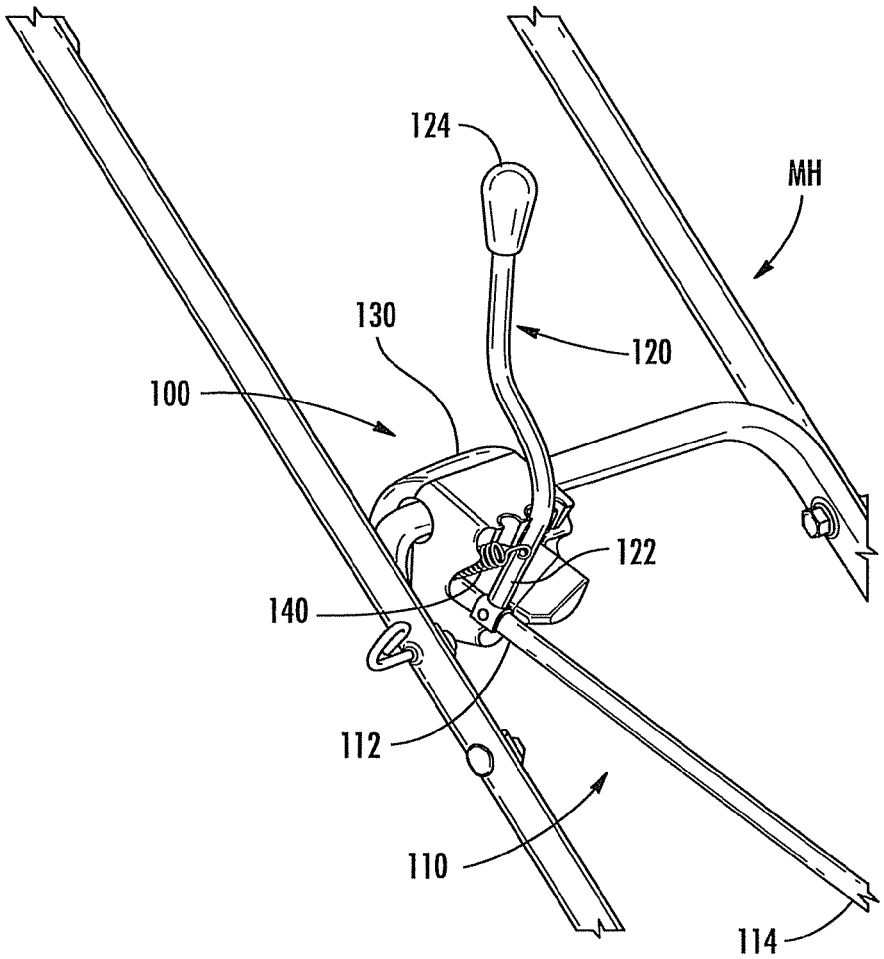
FIG. 2A is a perspective view of a chute control system according to an embodiment of the presently disclosed subject matter.
Figure 2B:
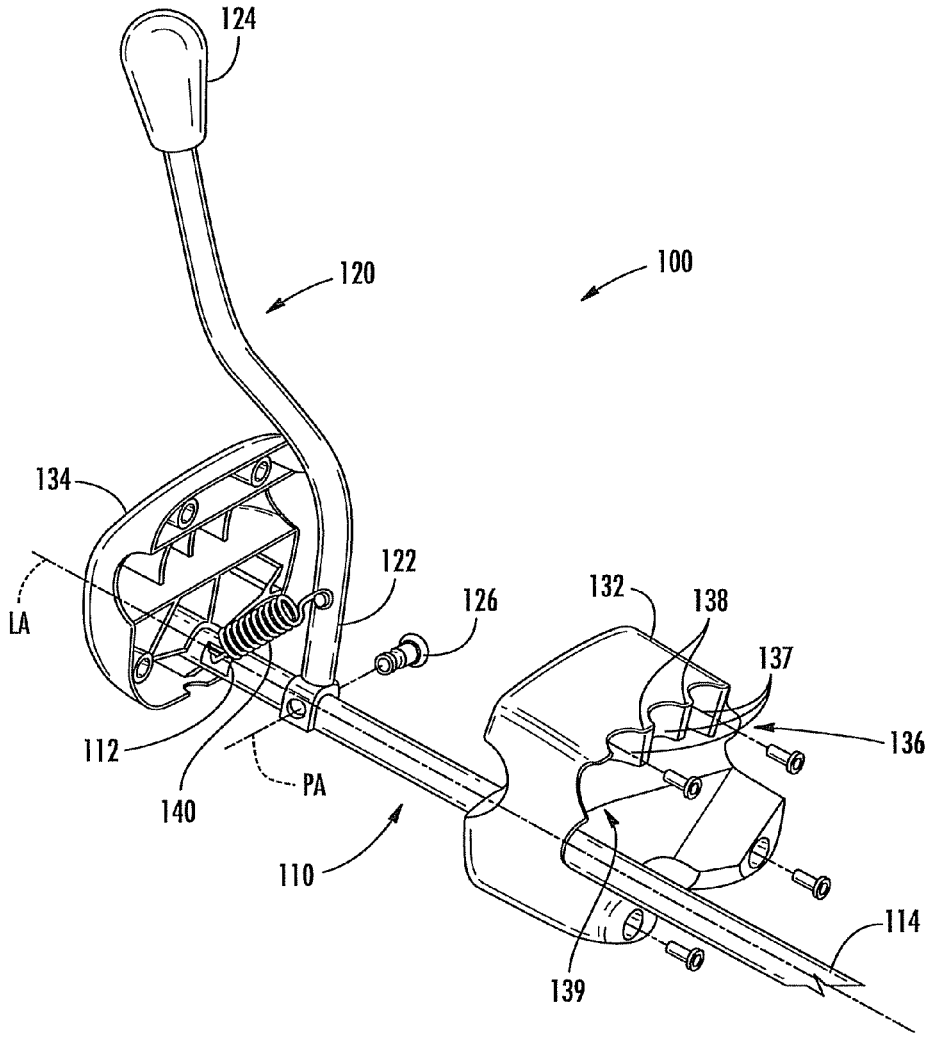
FIG. 2B is a partially exploded perspective view of a chute control system according to an embodiment of the presently disclosed subject matter.

To initiate and/or assist the rotation of positioning rod 110, chute control system 100 can further comprise a control lever 120 that can include a first end 122 connected to positioning rod 110 (e.g., at or near first end 112 of positioning rod 110). Specifically, as shown in FIG. 2B, control lever 120 can be connected to positioning rod 110 such that control lever 120 is substantially fixed with respect to positioning rod 110 for rotation about longitudinal axis LA. Accordingly, control lever 120 can moved laterally to cause a corresponding rotation of positioning rod 110 (i.e., about longitudinal axis LA), which can in turn cause rotation of snowblower chute C.

Figure 3:
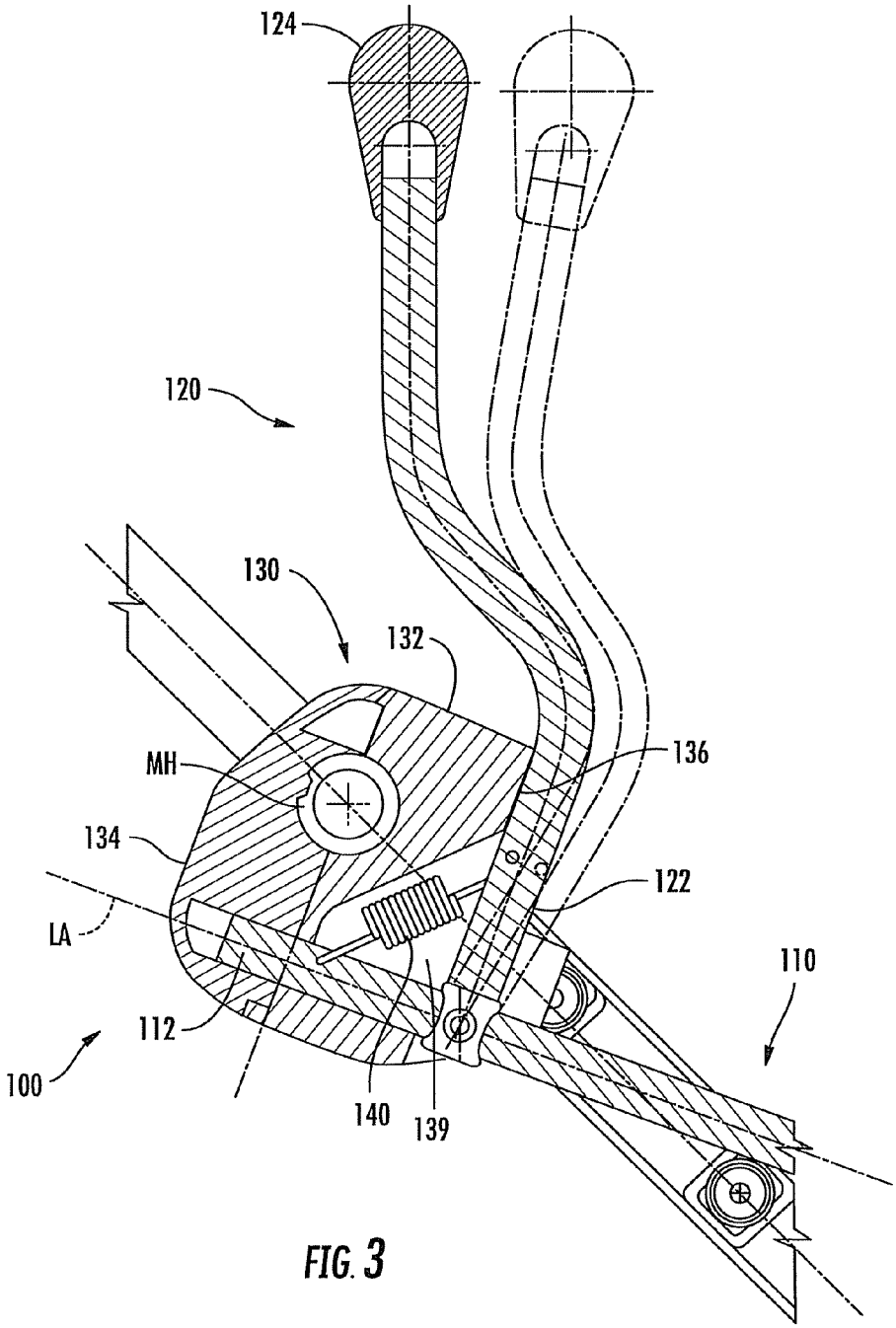
FIG. 3 is a side sectional view of a chute control system according to an embodiment of the presently disclosed subject matter.

Once snowblower chute C is rotated to desired position (i.e., to a desired angle with respect to the snowblower housing), it can be further desirable to maintain snowblower chute C in this position. In this regard, chute control system 100 can further comprise a positioning guide 130, which can be positioned at or near control lever 120. As shown in FIGS. 2A and 3, for example, positioning guide 130 can be connected to machine handle MH. Specifically, as shown in FIGS. 2B and 3, positioning guide 130 can comprise a first guide portion 132 and a second guide portion 134 that can be positioned on opposing sides of machine handle MH and joined together to thereby secure machine handle MH therebetween. Regardless of the specific configuration, positioning guide 130 can be positioned at or near first end 112 of positioning rod 110. In fact, in this configuration shown in FIGS. 2A and 3, positioning guide 130 can be configured to receive first end 112 of positioning rod 110 and can comprise a bearing surface with respect to which positioning rod 110 can rotate. In this way, positioning guide 130 can be configured to restrain spatial movement of positioning rod 110 with respect to machine handle MH while still allowing positioning rod 110 to rotate about longitudinal axis LA.

Figure 4:
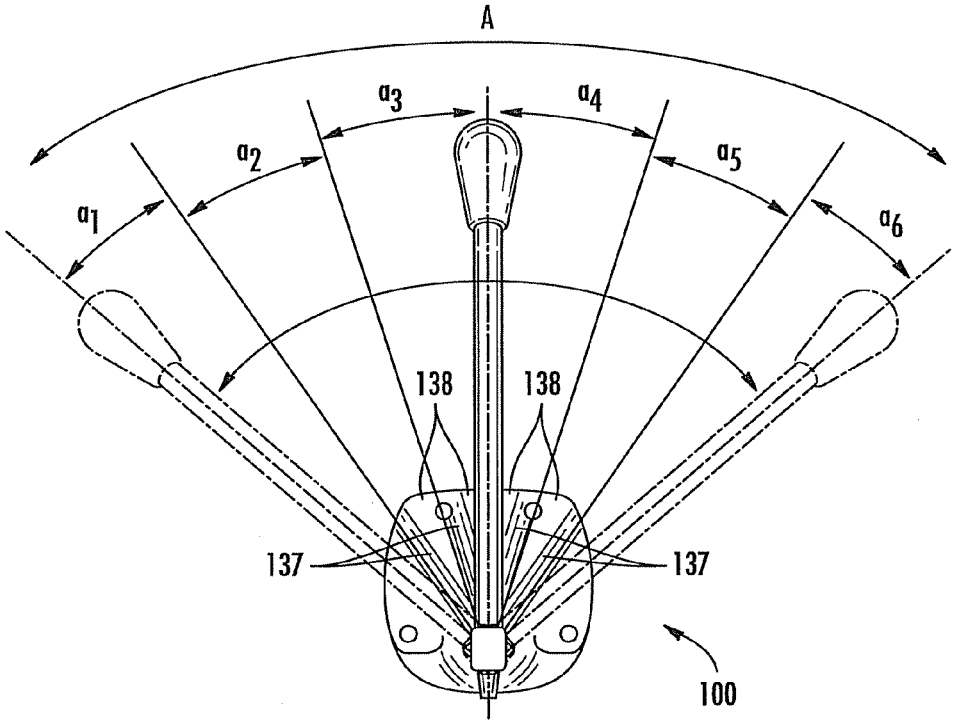
FIG. 4 is a top view illustrating discrete operating positions for a chute control system according to an embodiment of the presently disclosed subject matter.

To define one or more predetermined positions at which control lever 120 can be held, positioning guide 130 can comprise a retention surface, generally designated 136, positioned to face control lever 120 as shown in FIGS. 2A, 2B, and 4. Retention surface 136 can be configured to receive and hold control lever 120 at one or more selected angular positions with respect to longitudinal axis LA corresponding to one or more desired rotational positions of snowblower chute C. Specifically, for example, retention surface 136 can be configured to define one or more retention grooves 137 that are configured for receiving control lever 120 at one or more predetermined positions relative to machine handle NIH. In particular, each of retention grooves 137 can be formed as a concave (e.g., substantially cylindrical) configuration that can be an indentation depressed into retention surface 136 and can have a shape that is substantially complementary to a shape of control lever 120. In this configuration, control lever 120 can be positioned such that at least a portion of control lever 120 is substantially surrounded by the respective one of retention grooves 137. Each lateral edge of retention grooves 137 can comprise a detent 138 configured to at least partially restrict lateral movement of control lever 120 with respect to retention surface 136 (e.g., between adjacent retention grooves 137).

The number and spacing of retention grooves 137 can be selected to correspond to a number of desired rotational positions for snowblower chute C and a desired angular displacement between adjacent positions. Specifically, as shown in FIG. 4, for example, retention surface 136 can define five retention grooves 137 so that seven discrete positions are defined for control lever 120 (i.e., five positions corresponding to the five retention grooves 137 and one "overstroke" position on either side of retention surface 136 that is beyond each end of the row of retention grooves 137), although those having skill in the art will recognize that any number of retention grooves 137 can be provided depending on the desired number of rotational positions for snowblower chute C.

The spacing between adjacent retention grooves 137 can be designed to establish substantially similar angular increments. Referring again to FIG. 4, for example, adjacent retention positions (i.e., both retention grooves and "overstroke" positions) can be separated by incremental angular displacements $a_i$, where i is an integer between one and one less than the number of retention positions (e.g., the values of i are between 1 and 6 for the configuration shown in FIG. 4). The values of each of incremental angular displacements $a_i$ can be substantially equivalent (e.g., $a_i$ equal to between about 10 and 20 degrees for every value of i), or one or more of incremental angular displacements $a_i$ can have different values. Depending on the gear ratio between the rotation of positioning rod 110 and snowblower chute C, each of incremental angular displacements $a_i$ can correspond to comparatively larger rotations of snowblower chute C. As a result, a relatively small pivoting movement of control lever 120 can result in a comparatively large rotation of snowblower chute C. In this way, the sum of all of incremental angular displacements a; can define a total angular displacement A (e.g., between about 90 and 100 degrees) of control lever 120 that is less than the total rotational range of motion for snowblower chute C (e.g., up to about 200 degrees or greater).

To allow movement of control lever 120 along retention surface 136 (i.e., between retention grooves 137), control lever 120 can be configured to be pivotable with respect to positioning rod 110 about a pivot axis PA that intersects longitudinal axis LA (e.g., about a pivot axis PA that is substantially perpendicular to longitudinal axis LA). For example, referring to FIG. 2B, a pivot pin 126 can couple control lever 120 to positioning rod 110. In this configuration, pivot pin 126 prevents relative rotation of control lever 120 with respect to positioning rod 110 about longitudinal axis LA (i.e., the components are effectively locked in rotation together about longitudinal axis LA), but positioning rod 120 is able to pivot with respect to positioning rod 110 about pivot pin 126.

Accordingly, to change the position of snowblower chute C, control lever 120 can be pivoted "forward" (i.e., away from the operator's position and towards snowblower chute C) to disengage it from one of retention grooves 137 as shown in FIG. 3. Alternatively, positioning guide 130 can be mounted between control lever 120 and snowblower chute C with retention surface facing away from snowblower chute C, wherein control lever 120 is disengaged from retention surface 136 (e.g., out of engagement with one of retention grooves 137) by pivoting control lever 120 "backward" (i.e., towards the operator's position and away from snowblower chute C). In either configuration, once control lever 120 is disengaged from retention surface 136, it can then be laterally pivoted across retention surface 136 (i.e., side to side over detents 138) to cause a corresponding rotation of positioning rod 110 (i.e., about longitudinal axis LA), which can in turn cause rotation of snowblower chute C.

To hold control lever 120 in position within a selected one of retention grooves 137, chute control system 100 can comprise a biasing element 140 configured for exerting a force that urges control lever 120 towards retention surface 136 of positioning guide 130. For example, as shown in FIGS. 2A, 2B, and 3, biasing element 140 can be a spring (e.g., a coil tension spring), which can be connected between control lever 120 and a portion of positioning rod 110 positioned between control lever 120 and positioning guide 130. Specifically, positioning guide 130 can comprise a recess 139 formed below retention surface 136 in which biasing element 140 can be mounted.

Regardless of the specific configuration, biasing element 140 can be configured to exert a force that biases control lever 120 against retention surface 136, thereby restricting the ability of control lever 120 to pivot about longitudinal axis LA and cause rotation of positioning rod 110. In this way, control lever 120 can be held in a desired position with respect to retention surface 136, but it need not be locked in place. Stated otherwise, the configuration of biasing element 140 and/or retention surface 136 can cause control lever 120 to be held in a desired position without the use of a locking mechanism that needs to be engaged or disengaged to secure control lever 120 in a desired lever position.

In particular, the configuration of retention surface 136 can be designed such that biasing element 140 biases control lever 120 towards one of the selected angular positions with respect to longitudinal axis LA corresponding to the one or more desired rotational positions of snowblower chute C. Specifically, for example, detents 138 can be designed to not only resist movement of control lever 120 between adjacent retention grooves 137 but also to guide control lever 120 to the nearest of retention grooves 137. In this regard, detents 138 can have a substantially rounded profile such that if control lever 120 is positioned in contact with one of detents 138, biasing element 140 can urge control lever 120 to slide down the substantially rounded profile into engagement with an adjacent one of retention grooves 137. Alternatively or in addition, control lever 120 can have a substantially rounded cross-sectional (i.e., tubular) profile, and detents 138 can be sized to be less than half of a diameter of control lever 120 such that control lever 120 similarly slides towards a nearest of retention grooves 137.

Alternatively, retention surface 136 can be configured such that the edges of each of detents 138 serve as cam surfaces such that control lever 120 need not be disengaged from a respective on of retention grooves 137 before pivoting laterally about longitudinal axis LA. For example, as discussed above, each of detents 138 can have a substantially rounded profile. In this way, if a lateral force is exerted on control lever 120, the shape of retention grooves 137 and detents 138 can cause control lever 120 to travel up the curved sidewalls of the respective one of retention grooves 137 against the biasing force of biasing element 140. Control lever 120 can thus be moved laterally in this manner (i.e., pivoting about longitudinal axis LA) until it crosses over the respective one of detents 138, at which point the biasing force of biasing element 140 can pull control lever 120 in to rest within the adjacent one of retention grooves 137.

Regardless of the specific configuration, the shapes of retention grooves 137 and detents 138 and the spring force exerted by biasing element 140 can be designed such that the total resistance to movement of control lever 120 is not so great as to cause any discomfort to the customer. Rather, the shapes of retention grooves 137 and detents 138 and the spring force exerted by biasing element 140 can be configured such that there is sufficient resistance to prevent rotation of snowblower chute C during normal operation.

In the event that snowblower chute C is forcibly rotated in a manner not contemplated by normal operation (e.g., through inadvertent contact or misuse), a further consequence of the configuration of retention surface 136 discussed above can be that such direct rotation of snowblower chute C can cause rotation of positioning rod 110 and pivoting of control lever 120 about longitudinal axis LA without resulting in damage to chute control system 100. Specifically, as discussed above, retention surface 136 can be configured to resist lateral movement of control lever 120 (e.g., using detents 138) rather than rigidly restraining control lever 120 in any given position. Thus, any forced rotation of snowblower chute C that causes a corresponding rotation of positioning rod 110 can have the same effect as a predominantly lateral force being exerted on control lever 120 as discussed above. Accordingly, upon such forced rotation of snowblower chute C, the shape of retention grooves 137 and detents 138 can cause control lever 120 to travel up the curved sidewalls of the respective one of retention grooves 137 against the biasing force of biasing element 140. As a result, control lever 120 can be forced out of a given position (e.g., within one of retention grooves 137). Once the forced rotation of snowblower chute C stops, control lever 120 can be pivoted to thereby rotate snowblower chute C to a desired position. In this way, chute control system 100 can respond to such forced movement without incurring damage to its components.

This written description uses examples to disclose the subject matter, including the best mode, and also to enable any person skilled in the art to make and use the subject matter herein. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A snowblower chute position control device comprising:

a positioning rod comprising a first end pivotably connected to a machine handle and a second end connected to a snowblower chute such that rotation of the positioning rod about a longitudinal axis causes rotation of the snowblower chute;

a control lever connected to the positioning rod such that the control lever is substantially fixed with respect to the positioning rod for rotation about the longitudinal axis but is pivotable with respect to the positioning rod about a pivot axis that intersects the longitudinal axis;

a positioning guide comprising a retention surface facing the control lever and configured to retain the control lever at one or more selected angular positions with respect to the longitudinal axis corresponding to one or more desired rotational positions of the snowblower chute; and a biasing element configured for exerting a force to urge the control lever towards the retention surface of the positioning guide;

wherein the retention surface is configured to resist lateral movement of the control lever without rigidly restraining the control lever from lateral movement.

2. The snowblower chute position control device of claim 1, wherein the control lever is connected at or near the first end of the positioning rod.

3. The snowblower chute position control device of claim 1, wherein the pivot axis is substantially perpendicular to the longitudinal axis.

4. The snowblower chute position control device of claim 1, wherein the positioning guide is connected to the machine handle.

5. The snowblower chute position control device of claim 1, wherein the retention surface is configured to retain the control lever at one or more selected angular positions without locking the control lever in place with respect to the longitudinal axis.

6. The snowblower chute position control device of claim 1, wherein the retention surface comprises one or more retention grooves configured for receiving the control lever at one or more predetermined angles corresponding to one or more predetermined chute positions.

7. The snowblower chute position control device of claim 6, wherein the retention surface comprises detents positioned on each side of the one or more retention grooves, the one or more detents being configured to resist lateral motion of the control lever with respect to the retention surface.

8. The snowblower chute position control device of claim 7, wherein each of the detents has a substantially rounded profile.

9. The snowblower chute position control device of claim 7, wherein each of the detents has a width that is less than half of a diameter of the control lever.

10. The snowblower chute position control device of claim 1, wherein the biasing element comprises a spring.

11. The snowblower chute position control device of claim 10, wherein the spring is connected between the control lever and a portion of the positioning rod positioned between the control lever and the positioning guide.

12. The snowblower chute position control device of claim 11, wherein the spring is positioned in a recess formed in the positioning guide.

13. A rotatable snowblower chute and control system comprising:

a snowblower chute rotatable with respect to a snowblower housing;

a machine handle extending from the snowblower housing;

a positioning rod comprising a first end pivotably connected to the machine handle and a second end connected to the snowblower chute such that rotation of the positioning rod about a longitudinal axis causes rotation of the snowblower chute;

a control lever connected to the positioning rod such that the control lever is substantially fixed with respect to the positioning rod for rotation about the longitudinal axis but is pivotable with respect to the positioning rod about a pivot axis that intersects the longitudinal axis;

a positioning guide connected to the machine handle, the positioning guide comprising a retention surface facing the control lever and comprising one or more retention grooves configured for receiving the control lever at one or more predetermined angles corresponding to one or more predetermined rotational positions of the snowblower chute; and a biasing element configured for exerting a force to urge the control lever towards the retention surface of the positioning guide;

wherein the retention surface is configured to resist lateral movement of the control lever without rigidly restraining the control lever from lateral movement.

14. The rotatable snowblower chute and control system of claim 13, wherein the retention surface comprises detents positioned on each side of the one or more retention grooves, the one or more detents being configured to resist lateral motion of the control lever with respect to the retention surface.

15. A method for rotating a snowblower chute, the method comprising:

pivotably connecting a positioning rod to a snowblower chute such that rotation of the positioning rod about a longitudinal axis causes rotation of the snowblower chute; and rotating a control lever connected to the positioning rod about the longitudinal axis to cause rotation of the positioning rod, wherein rotating the control lever comprises pivoting the control lever with respect to the positioning rod about a pivot axis that intersects the longitudinal axis to disengage the control lever from a positioning guide comprising a retention surface facing the control lever and configured to retain the control lever at one or more selected angular positions with respect to the longitudinal axis corresponding to one or more desired rotational positions of the snowblower chute, wherein the retention surface resists lateral movement of the control lever without rigidly restraining the control lever from lateral movement.

16. The method of claim 15, wherein pivoting the control lever with respect to the positioning rod comprises pivoting the control lever about a pivot axis that is substantially perpendicular to the longitudinal axis.

17. The method of claim 15, wherein pivoting the control lever with respect to the positioning rod comprises pivoting the control lever towards the snowblower chute.

18. The method of claim 15, wherein pivoting the control lever to disengage the control lever from a positioning guide comprises pivoting the control lever to disengage the control lever from one of a plurality of retention grooves defined in the retention surface.

19. The method of claim 18, wherein rotating a control lever connected to the positioning rod about the longitudinal axis comprises rotating the control lever over one or more detents positioned on each side of the one or more retention grooves, the one or more detents being configured to resist lateral motion of the control lever with respect to the retention surface.

20. The method of claim 15, comprising pivoting the control lever into engagement with the retention surface of the positioning guide once the control lever is positioned at one of the one or more selected angular positions.

21. The method of claim 20, wherein pivoting the control lever into engagement with the retention surface comprises retaining the control lever at one or more selected angular positions without locking the control lever in place with respect to the longitudinal axis.

22. The method of claim 20, wherein pivoting the control lever into engagement with the retention surface comprises pivoting the control lever into engagement with one of a plurality of retention grooves defined in the retention surface.

* * * * *